US007892504B2

(12) United States Patent
Taike et al.

(10) Patent No.: US 7,892,504 B2
(45) Date of Patent: Feb. 22, 2011

(54) PHARMACEUTICAL SAMPLE STORAGE SYSTEM

(75) Inventors: Hiroyuki Taike, Osaka (JP); Kazuhiro Tsutsumi, Osaka (JP); Jun Ohshimo, Osaka (JP); Tomoyoshi Okamoto, Osaka (JP); Hisao Nishii, Osaka (JP); Nobuaki Matsumoto, Osaka (JP); Yukio Ueyama, Hyogo (JP)

(73) Assignee: Tsubakimoto Chain Co., Osaka (JP)

( * ) Notice: Subject to any disclaimer, the term of this patent is extended or adjusted under 35 U.S.C. 154(b) by 399 days.

(21) Appl. No.: 11/473,294

(22) Filed: Jun. 22, 2006

(65) Prior Publication Data

US 2007/0017885 A1 Jan. 25, 2007

(30) Foreign Application Priority Data

Jul. 22, 2005 (JP) ..... 2005-212690

(51) Int. Cl.
*B01L 3/02* (2006.01)
*B65D 6/04* (2006.01)

(52) U.S. Cl. ..... 422/562; 422/552; 422/553; 422/561; 206/565; 206/593

(58) Field of Classification Search ..... 211/40, 211/69.1, 69.2–69.9, 70.6, 70.7, 74, 85.18; 422/65, 102, 104; 206/565, 593; 435/283.1, 435/305.2, 307.1
See application file for complete search history.

(56) References Cited

U.S. PATENT DOCUMENTS 263,116 A * 8/1882 Close ..... 217/19
353,600 A * 11/1886 Sloan ..... 215/10
840,558 A * 1/1907 Denmead ..... 217/35
955,164 A * 4/1910 Husted ..... 224/191
1,022,971 A * 4/1912 Roberts ..... 217/19
1,236,085 A * 8/1917 Hudnut ..... 206/560
1,681,110 A * 8/1928 Friedman ..... 206/199
1,869,717 A * 8/1932 Silver ..... 118/503
2,467,873 A * 4/1949 Weir ..... 211/74
2,636,615 A * 4/1953 Bradley ..... 211/69.8
2,878,920 A * 3/1959 Rayman ..... 198/803.14

(Continued)

FOREIGN PATENT DOCUMENTS

EP 1477226 11/2004

(Continued)

*Primary Examiner*—Michael Safavi
*Assistant Examiner*—Joshua Rodden
(74) *Attorney, Agent, or Firm*—Woodling, Krost and Rust

(57) ABSTRACT

A pharmaceutical sample storage system in which the accommodation volume of a case is increased is disclosed and claimed. The molding of the storage rack is easy. The cases in the storage rack are locked in place and will not fall out even if the storage rack is turned upside down. Placing and removing cases from the storage rack is highly accurate. The sample storage system is sealed and the storage rack vertically accommodates a plurality of cases in a matrix. The cases are rectangular in cross-section and are hollow. The cases are tapered toward the bottom portion of the case and the outer surfaces of the cases are chamfered. The storage rack has a lower grate-shaped bottom portion which is partitioned by cross members. The bottom portion of the case being fitted into one partitioned portion of the grate-shaped bottom portion and has case supporting pins vertically provided upward from each intersection of gratings or cross members of the grated bottom portion.

11 Claims, 13 Drawing Sheets

U.S. PATENT DOCUMENTS 3,176,504 A * 4/1965 Shapiro ..... 211/70.1
3,327,885 A * 6/1967 Carle et al. ..... 220/510
3,381,825 A * 5/1968 Bessett ..... 211/74
3,463,323 A * 8/1969 Riepe ..... 211/69.5
3,643,812 A * 2/1972 Mander et al. ..... 211/74
3,825,126 A * 7/1974 Pohl et al. ..... 211/85.23
3,889,416 A * 6/1975 Bergeron et al. ..... 47/86
4,154,795 A 5/1979 Thorne
4,159,597 A * 7/1979 Olsen ..... 47/58.1 R
4,168,955 A * 9/1979 Allington ..... 436/47
4,798,292 A * 1/1989 Hauze ..... 206/439
4,948,564 A 8/1990 Root et al.
4,956,150 A * 9/1990 Henry ..... 422/102
5,084,246 A * 1/1992 Lyman et al. ..... 422/101
5,096,672 A * 3/1992 Tervamaki et al. ..... 422/102
5,098,676 A * 3/1992 Brooks, Jr. ..... 422/292
5,112,574 A * 5/1992 Horton ..... 422/102
RE34,133 E * 11/1992 Thorne ..... 422/99
5,201,430 A * 4/1993 Artzer ..... 211/70.6
5,211,915 A * 5/1993 Monch ..... 422/102
5,248,035 A 9/1993 Gallagher
5,279,800 A * 1/1994 Berry, Jr. ..... 422/300
5,307,144 A * 4/1994 Hiroshi et al. ..... 356/244
5,340,551 A * 8/1994 Berry, Jr. ..... 422/300
5,358,871 A * 10/1994 Stevens et al. ..... 435/297.1
5,379,900 A * 1/1995 Gregg et al. ..... 206/571
5,407,648 A * 4/1995 Allen et al. ..... 422/297
5,514,343 A * 5/1996 Verwohlt et al. ..... 422/104
5,525,304 A * 6/1996 Matsson et al. ..... 422/104
5,540,891 A * 7/1996 Portmann et al. ..... 422/102
5,759,494 A * 6/1998 Szlosek ..... 422/102
5,766,561 A * 6/1998 Frieze et al. ..... 422/297
5,792,426 A * 8/1998 Portmann et al. ..... 422/102
5,823,363 A * 10/1998 Cassel ..... 211/60.1
5,858,309 A * 1/1999 Mathus et al. ..... 422/102
5,888,454 A * 3/1999 Leistner et al. ..... 422/52
5,950,832 A * 9/1999 Perlman ..... 206/446
5,962,250 A * 10/1999 Gavin et al. ..... 435/29
6,015,534 A * 1/2000 Atwood ..... 422/102
6,018,388 A * 1/2000 Nawracala et al. ..... 356/246
D420,743 S * 2/2000 Monks ..... D24/224
6,048,504 A * 4/2000 Riley ..... 422/300
6,103,169 A * 8/2000 Mathus et al. ..... 264/266
6,193,064 B1 * 2/2001 Finneran ..... 206/443
6,297,018 B1 * 10/2001 French et al. ..... 435/6
6,340,589 B1 * 1/2002 Turner et al. ..... 435/287.2
6,503,456 B1 * 1/2003 Knebel ..... 422/102
6,669,911 B1 * 12/2003 Swanson ..... 422/102
6,685,034 B1 * 2/2004 Cooke ..... 211/40
6,776,964 B1 * 8/2004 Wijnschenk et al. ..... 422/99
6,827,907 B2 * 12/2004 Fattinger et al. ..... 422/104
6,838,051 B2 * 1/2005 Marquiss et al. ..... 422/63
6,875,405 B1 * 4/2005 Mathus et al. ..... 422/102
7,018,588 B2 * 3/2006 DeSilets et al. ..... 422/101
7,128,878 B2 * 10/2006 Muser ..... 422/102
D534,658 S * 1/2007 Bargh ..... D24/229
7,252,803 B2 * 8/2007 Guthrie et al. ..... 422/104
7,410,618 B2 * 8/2008 Muser ..... 422/102
2001/0002986 A1 * 6/2001 Fattinger et al. ..... 422/104
2002/0108917 A1 * 8/2002 Maruyama ..... 211/74
2002/0151045 A1 * 10/2002 Turner et al. ..... 435/288.4
2005/0207945 A1 * 9/2005 Itoh ..... 422/104
2006/0186068 A1 * 8/2006 Bewsky ..... 211/69.1
2007/0125725 A1 * 6/2007 Kemper et al. ..... 211/41.3
2007/0217958 A1 * 9/2007 Orha et al. ..... 422/102
2007/0251892 A1 * 11/2007 Taike et al. ..... 211/13.1
2007/0258864 A1 * 11/2007 Braymer et al. ..... 422/102

FOREIGN PATENT DOCUMENTS

EP 1477226 A1 * 11/2004
EP 06013680 ESR 10/2007
GB 758517 10/1956
GB 758517 A 10/1956
JP 3421252 6/1999
JP 2004-004070 1/2004
JP 2005-212690 SR 10/2009

* cited by examiner

PHARMACEUTICAL SAMPLE STORAGE SYSTEM

This patent application claims priority of Japanese patent application No. 2005-212690 filed Jul. 22, 2005.

TECHNICAL FIELD

The present invention relates to a sample storage system for pharmaceutical development used for identifying and storing a number of samples. Samples may be used in the field of wound medicine research. The present invention relates to a sample storage system for pharmaceutical development wherein cases in which samples for pharmaceutical development are sealed and placed in a storage rack. The storage rack vertically stores a plurality of sample storage cases in a matrix.

BACKGROUND TECHNOLOGY

In the field of wound medicine research, for example, the storage and transportation of a storage rack has been carried out by sealing or encapsulating a sample-dissolved solution into a cylindrical case called a microtube. The storage rack accommodates a plurality of microtubes partitioned in a matrix, for example partitioned in a matrix of 8 columns and 12 rows for handling 96 microtubes. The microtubes are provided in a vertically oriented manner as shown in FIG. 9(*a*). Further, to accommodate smaller microtubes, for instance, ultramicrotubes in the same size storage rack may be partitioned in a matrix with 16 columns and 24 rows to handle 384 ultramicrotubes as shown in FIG. 9(*b*). See for example, Patent Reference 1 which is Japanese Laid-Open Patent Publication No. 2000-4070 (page 11, lines 1 to 20, FIG. 6). Also, see Patent Reference 2 which is Japanese Patent No. 3421252 (page 2, paragraph 5, FIG. 1).

SUMMARY OF THE INVENTION

Problems to be Solved by the Invention

Since the above-mentioned conventional ultramicrotube has a shape in which the bottom surface size is reduced to substantially ¼ the size of a standard microtube, the capacity of samples is also decreased so there must be a way to effectively utilize the space available. Further, since the dimensions of the grate of the storage rack are small, it is difficult to mold the storage rack.

Since the cases are inserted into a square partitioned portion of a grate in a storage rack, when the storage rack is turned upside down, the cases fall out. If this happens then there is an enormous loss of samples. Further, to reduce the cost of manufacturing the storage racks, the storage rack frame has a dimensional accuracy less than a grate-shaped bottom portion of the storage rack which is formed inside the storage rack frame. Accordingly, a problem of lowered picking accuracy has been pointed out.

Accordingly, the object of the present invention is to provide a pharmaceutical sample storage system in which the accommodation volume of a case for the sample is increased, the molding of the storage rack is easy, the case does not fall out even if the storage rack is turned upside down and the picking of the case from the storage rack is performed with high accuracy and efficiency.

Means for Solving the Problems

The invention provides a pharmaceutical sample storage system for cases in which samples are sealed therein and stored vertically in a storage rack accommodating a plurality of cases arranged in a matrix. The cases are rectangular in cross-section and hollow. The cases are tapered toward the bottom portion of the case and the corner portions of the outer surfaces of the cases are chamfered. The storage rack has a lower grate-shaped bottom portion partitioned inside a rack frame. The bottom portion of the case is fitted into one partitioned portion of the grate-shaped bottom portion. Supporting pins extend vertically upward from each intersection of gratings of the grated bottom portion. By gratings it is meant the cross members which form the partitions.

It is noted that the chamfered corner portions of the cases in the present invention means a so-called C chamfering in which a right angular corner portion is corner-cut at an angle of 45°. And a lower grate-shaped bottom portion means that it has substantially the same level of a side wall of the bottom portion of the case. Further, the case in the present invention means a microtube or the like in which a sample for a wound medicine is sealed. The cases are available for use with other medicines and with other substances other than medicines. The case may be one of 384 cases which can be accommodated in a matrix with 16 columns and 24 rows. A conventional storage rack includes 96 cases arranged in a matrix with 8 columns and 12 rows.

The invention, in addition to the configuration already described, further includes protrusions extending from inner side surfaces of the partitions which form the grate-shaped bottom portion. The partitions are formed by cross members which include inner side surfaces. The inner side surfaces are provided with case locking protrusions. A case locking concave portion is provided in each of the side walls of the bottom portion of the case. The case locking protrusions and case locking concave portions are fitted to each other when the case is inserted in the storage rack.

The invention further includes case supporting pins which may be either circular or square in cross-section. The invention further includes supporting pins whose taper is thinner toward the tip portion.

The invention further includes a molded grate-shaped bottom portion having a dimensional accuracy higher than the storage rack frame. The grate-shaped bottom portion includes first and second orienting protrusions which are located on orthogonal walls or perpendicular walls. The first and second orienting protrusions are orthogonal or perpendicular and are used in conjunction with actuators and fixing jigs to accurately position the storage rack relative to these highly accurate orienting protrusions. The orienting protrusions are sometimes referred to herein as positioning protrusions.

Effects of the Invention

The invention is a pharmaceutical sample storage system which includes a plurality of cases containing a plurality of samples which are sealed and vertically stored in a storage rack. The storage rack and the cases are arranged in a matrix. The cases are rectangularly shaped in cross-section and are hollow. The cases are tapered toward their bottom portions and are chamfered on the corner portions of the outer surfaces of the cases. The storage rack has a lower grate-shaped bottom portion partitioned in a grate manner inside the storage rack frame. The bottom portion of the case is fitted into one partition of the grated bottom portion. The grate-shaped bottom portion includes case supporting pins provided vertically upward from each of the intersection of gratings (sometimes herein the grating are referred to as cross members) of the grated bottom portion. High partitioning walls do not exist in the storage rack and the cross-section of the case area is increased as large as possible by chamfering the corners of the rectangularly-shaped in cross-section case. Thus the volume of sample per case can be increased.

The invention includes partitions which form the grate-shaped bottom portion. The partitions are made up of cross members which form a grid or a grate. Each cross member includes an inner side surface thereof which includes case locking protrusions on each inner side of each cross member. Each case includes side walls and a bottom portion of the side walls include case locking concave portions therein which interengage the protrusions of the inner side surface of the cross members which form the partitions. The interengagement of the protrusions of the cross members of the partitions which form the grate-shaped bottom portion of the storage rack with the concavities in the bottom portions of the cases prevents the cases from falling out of the storage rack even when the storage rack is turned upside down. This results in saving the samples and keeping them in order as they are stored in the storage rack in order to facilitate further use of them.

Case supporting pins which extend vertically from the bottom portion of the storage rack are circular or square in cross-section. The sample cases include chamfered corner portions so as to efficiently house four cases adjacent a particular supporting pin. Thus, the volume or space available for the cases in a given storage rack is increased and more samples can be stored because more cases can be stored in the storage rack.

Case supporting pins are tapered such that they are thinner toward the tip portion of the pin as they extend away from the bottom portion of the case. Tapered pins and cases having chamfered corners enable the easy insertion of the case into the storage rack.

The grate-shaped bottom portion is molded to a dimensional accuracy or tolerance which is higher than the dimensional tolerance or accuracy of the storage rack frame. Positioning or orienting protrusions extend from two sides of the grate-shaped bottom portion. The two sides are perpendicular to each other and the positioning of the storage rack can be facilitated at high accuracy with respect to the dimensionally accurate grate-shaped bottom portion of the storage rack in spite of the fact that the outermost surface of the storage rack has poor dimensional accuracy. The dimensional accuracy of the grate-shaped bottom portion of the storage rack determines the ultimate positioning of the cases so that they may be removed or inserted into the rack.

The drawings will be better understood when reference is made to the Description Of The Invention and Claims which follow hereinbelow.

DESCRIPTION OF THE INVENTION

Figure 1:
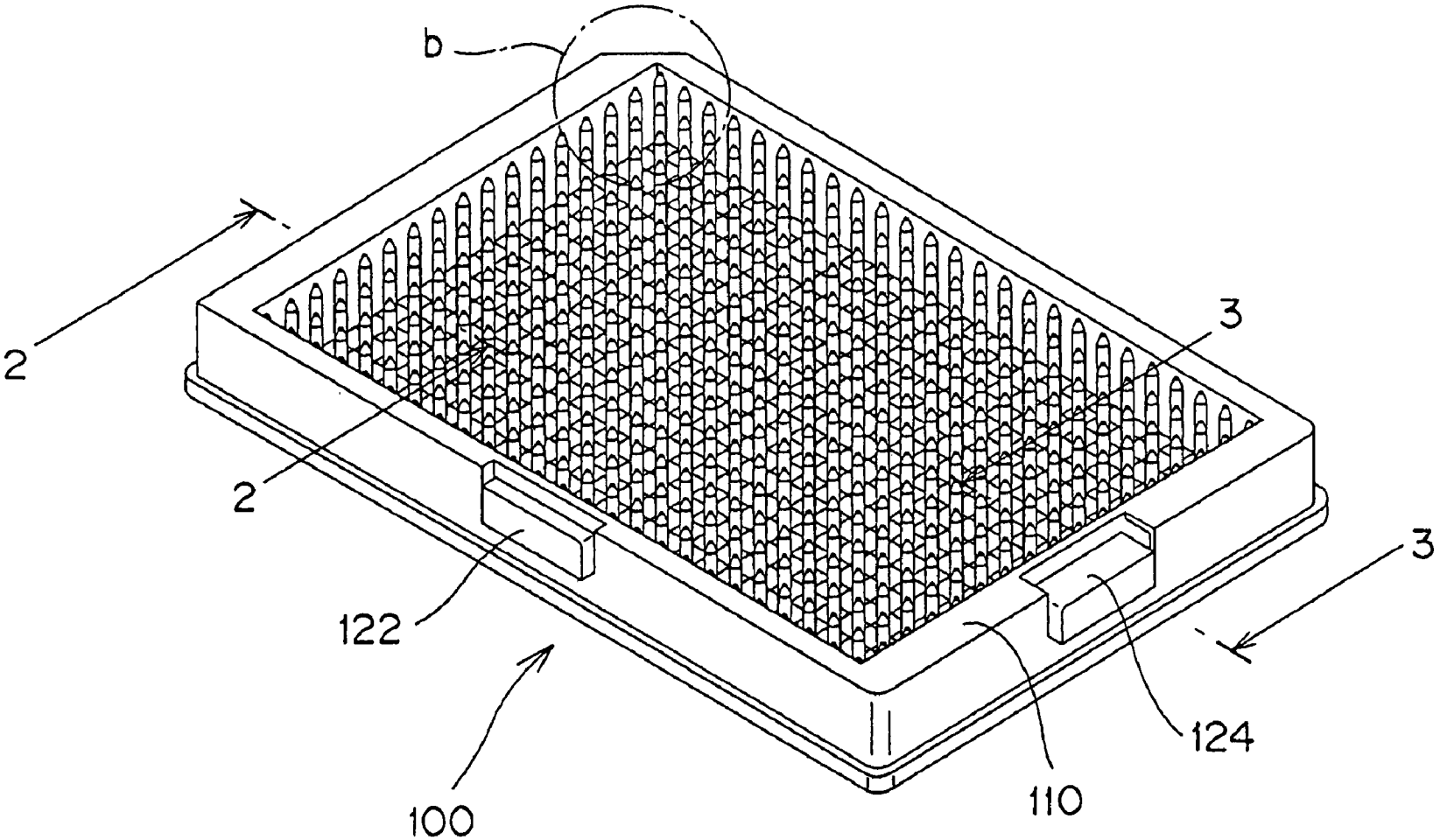
FIGS. 1(*a*) and 1(*b*) are perspective views of a storage rack in a pharmaceutical sample storage system according to the present invention.
Figure 1:
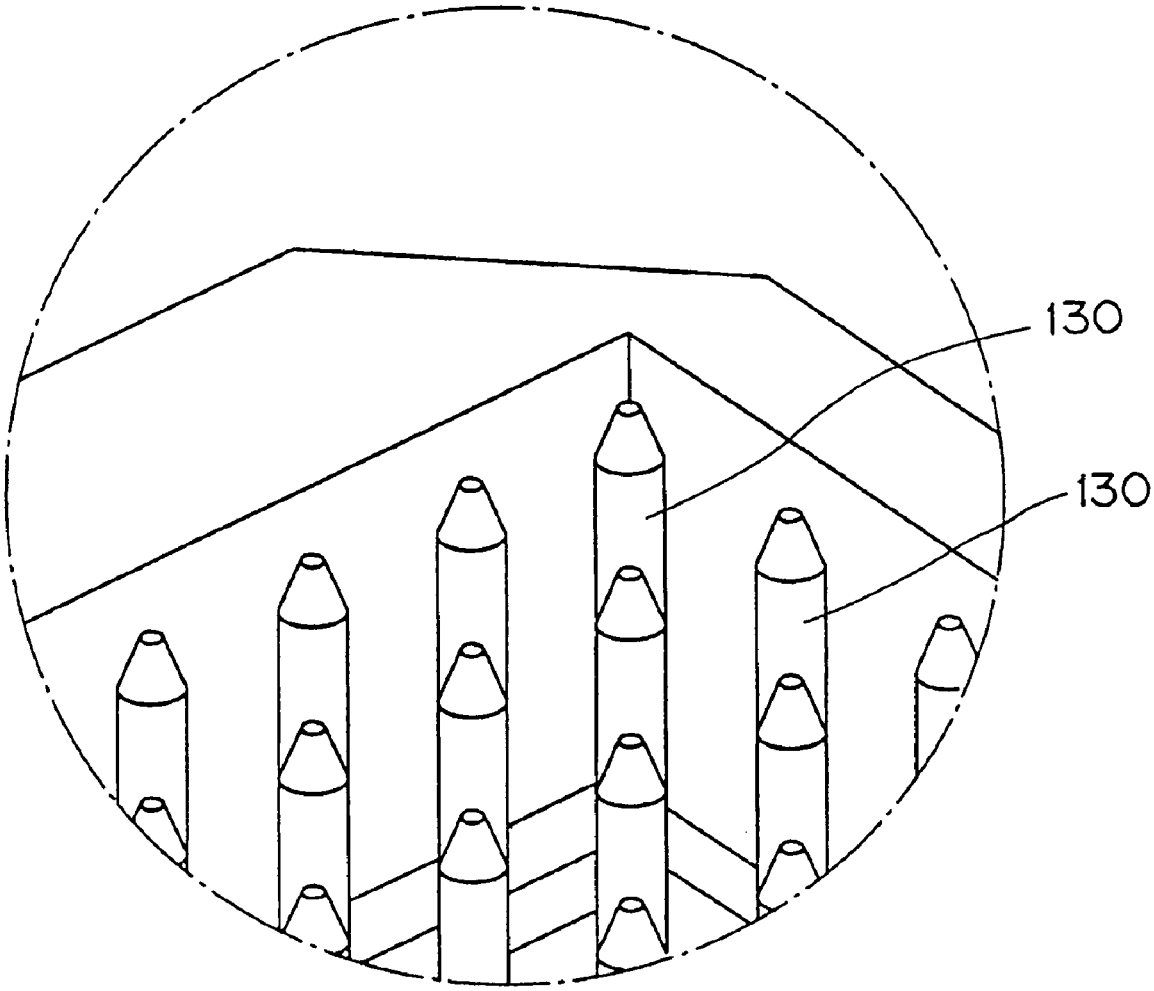
Figure 2:
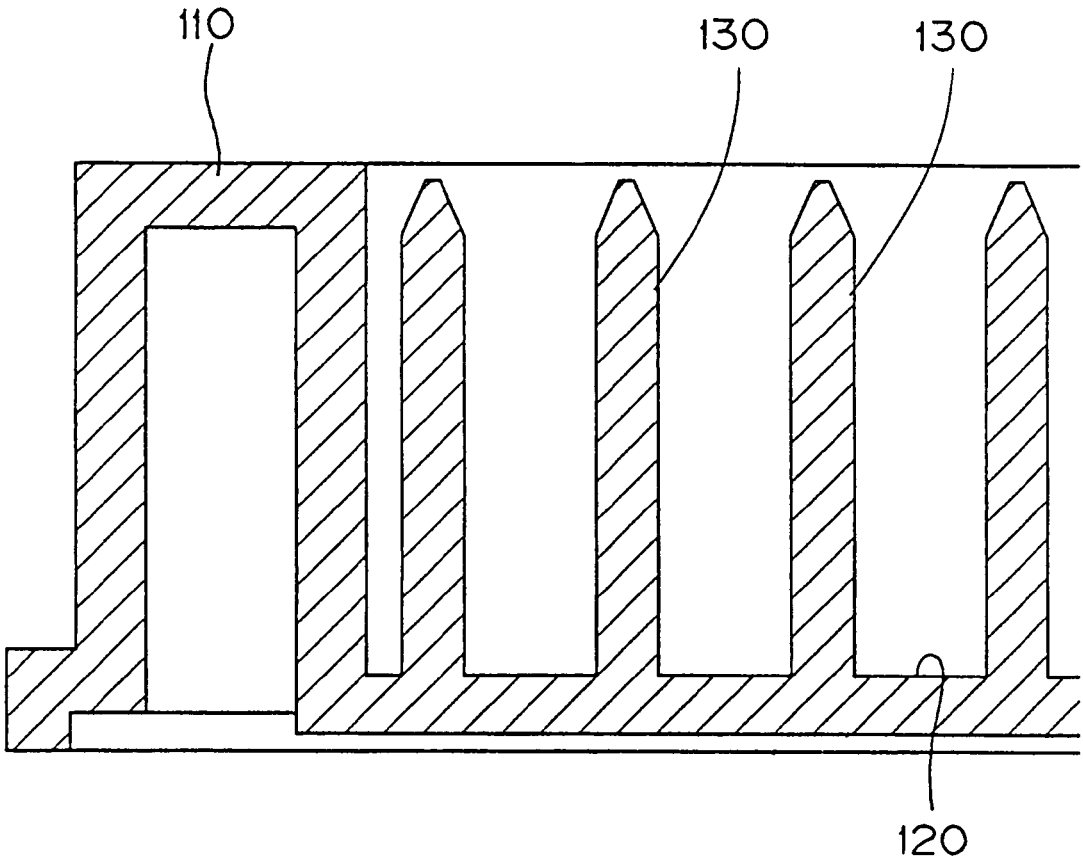
FIG. 2 is a cross-sectional view of the storage rack through the line 2-2 shown in FIG. 1.
Figure 3:
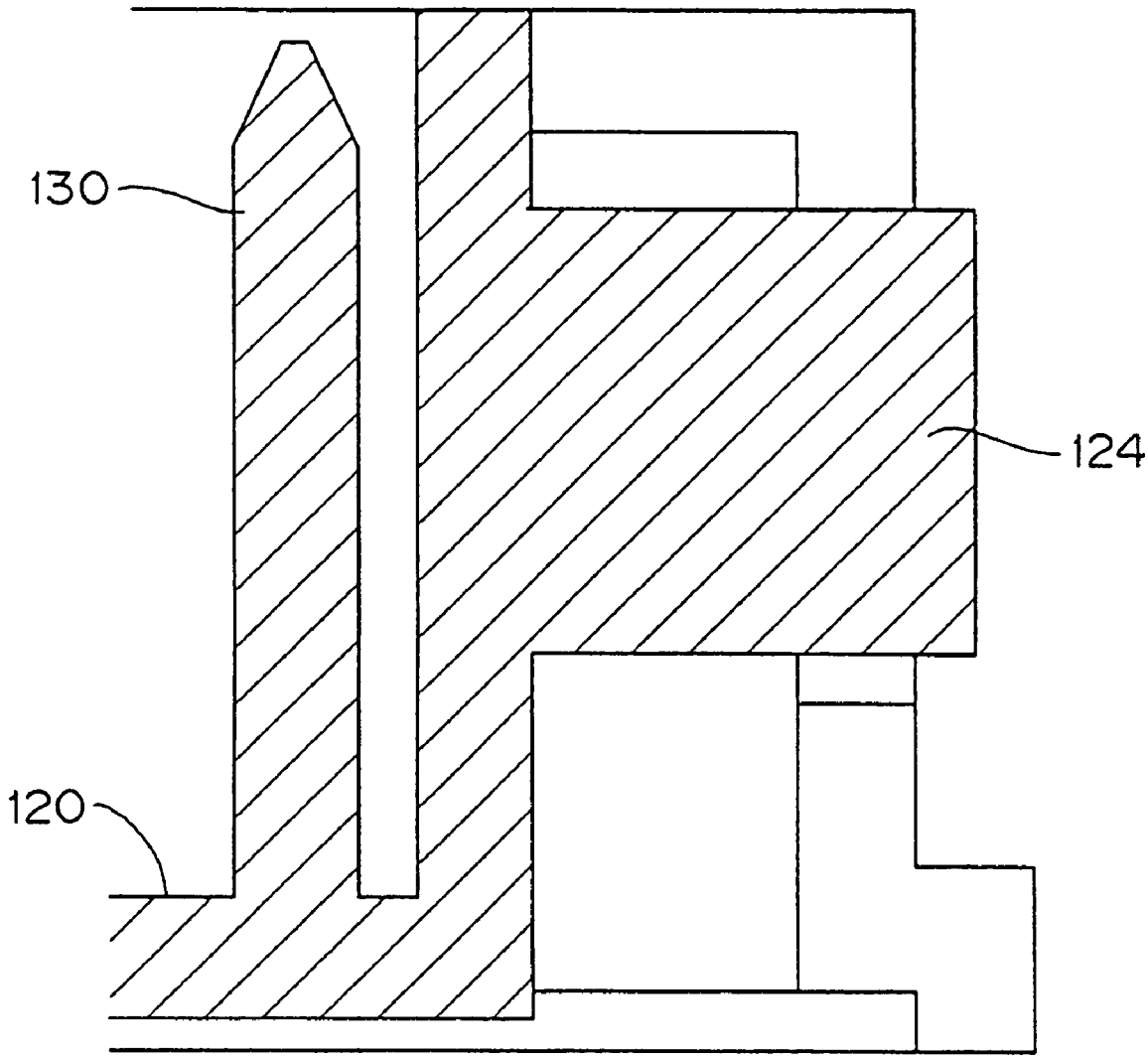
FIG. 3 is a cross-sectional view of the storage rack through the line 3-3 shown in FIG. 1.

Next a pharmaceutical sample storage system according to the present invention will be described with reference to drawings. FIG. 1(*a*) shows a perspective view of a storage rack for vertically accommodating a plurality of cases in which samples for pharmaceutical development are sealed. FIG. 1(*b*) shows an enlarged portion of FIG. 1(*a*). FIG. 2 shows a cross-sectional view through line 2-2 of FIG. 1(*a*), and FIG. 3 shows a cross-sectional view through line 3-3 of FIG. 1(*a*).

Figure 6:
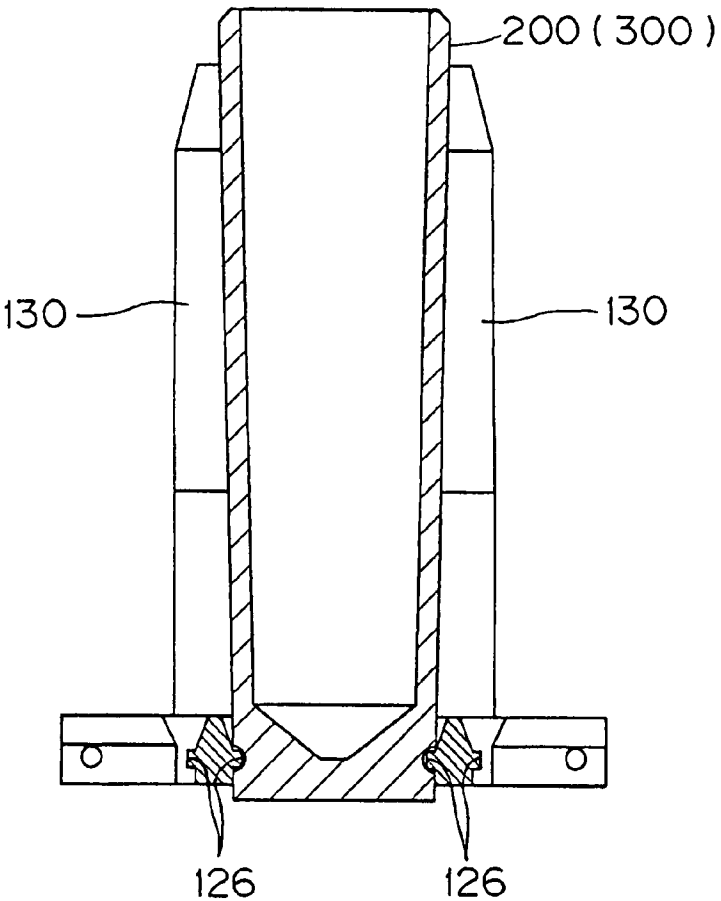
FIGS. 6(*a*) and 6(*b*) are perspective views showing case supporting structure including case supporting pins each having a circular cross-section.
Figure 6:
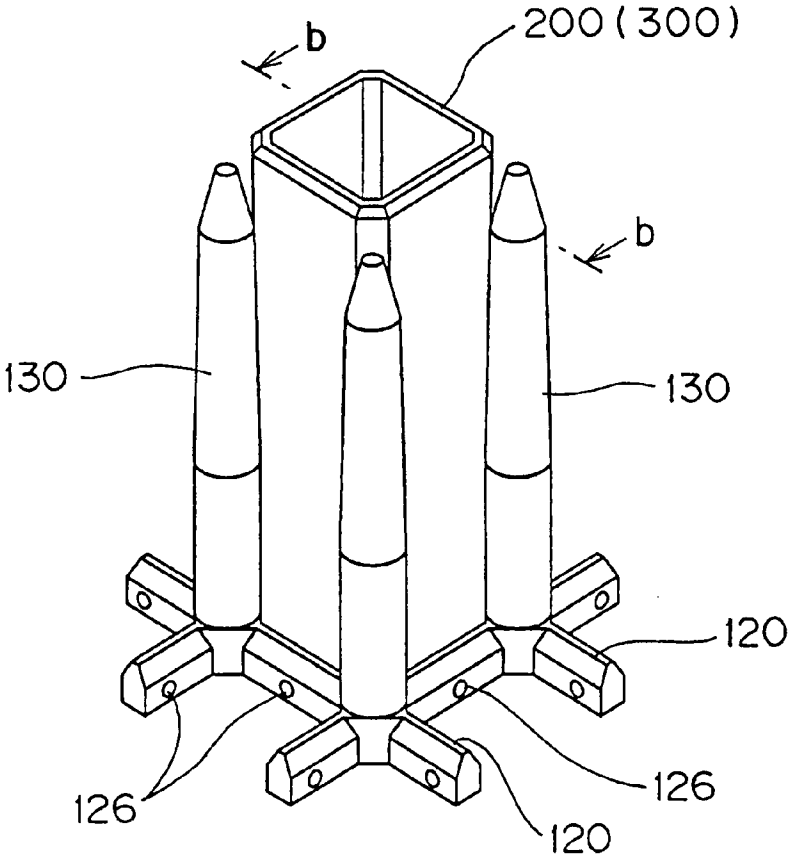
Figure 7:
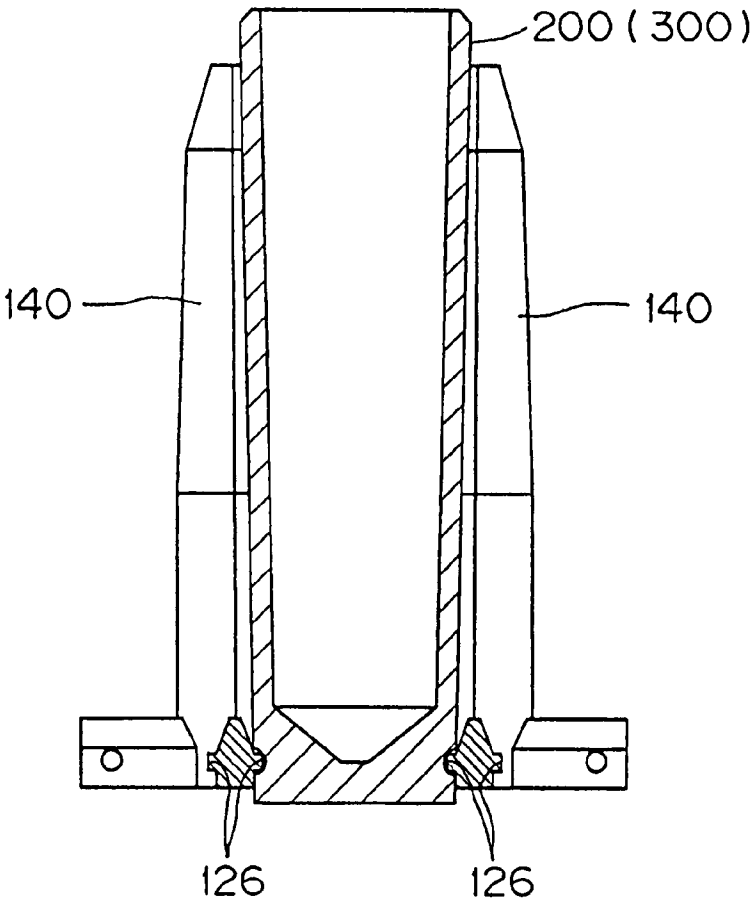
FIGS. 7(*a*) and 7(*b*) are perspective views showing case supporting structure including case supporting pins each having a square cross-section.
Figure 7:
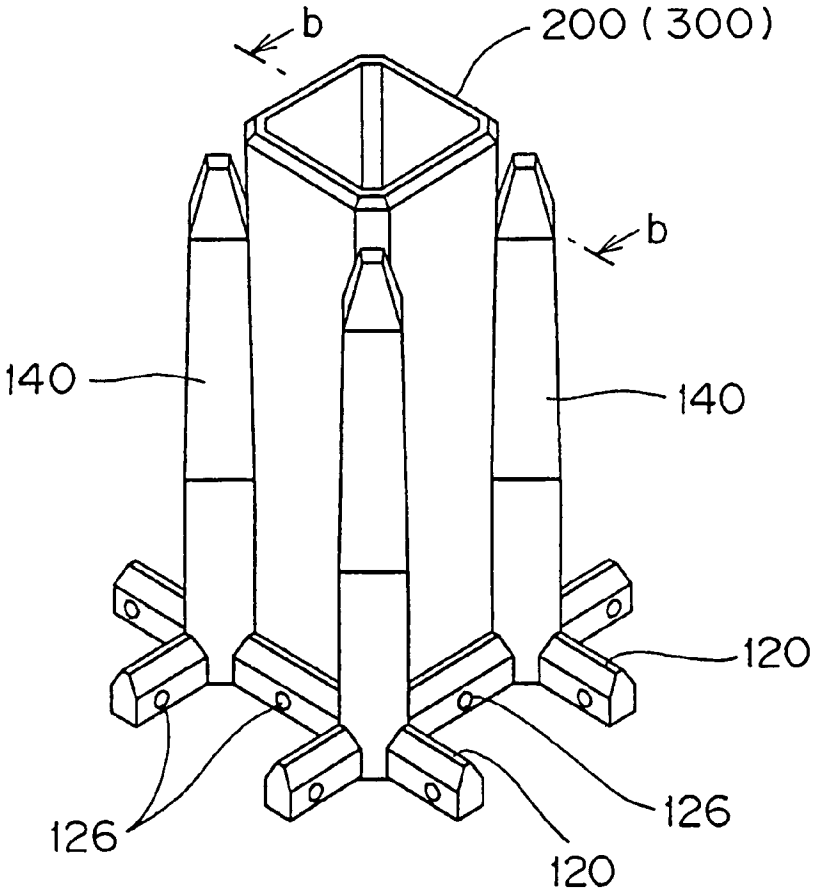

A storage rack 100 in the present invention includes a lower grate-shaped bottom portion. The grate-shaped bottom portion includes partitions inside a rack frame 110 forming the outer frame of the storage rack 100 as shown in FIGS. 1 to 3. Cases 200, 300 include bottom portions 230,330. Bottom portion side walls 230, 330 of cases 200, 300 (shown in FIGS. 4(*a*), 4(*b*), 5(*a*) and 5(*b*)) are respectively fitted into a partitioned portion of the grate-shaped bottom portion 120 as shown in FIGS. 6 and 7. Further, case supporting pins 130, 140 are vertically provided and extend upwardly from the respective intersections of cross members of the grate-shaped bottom portions 120. The gratings or cross members form the partitions.

Figure 4:
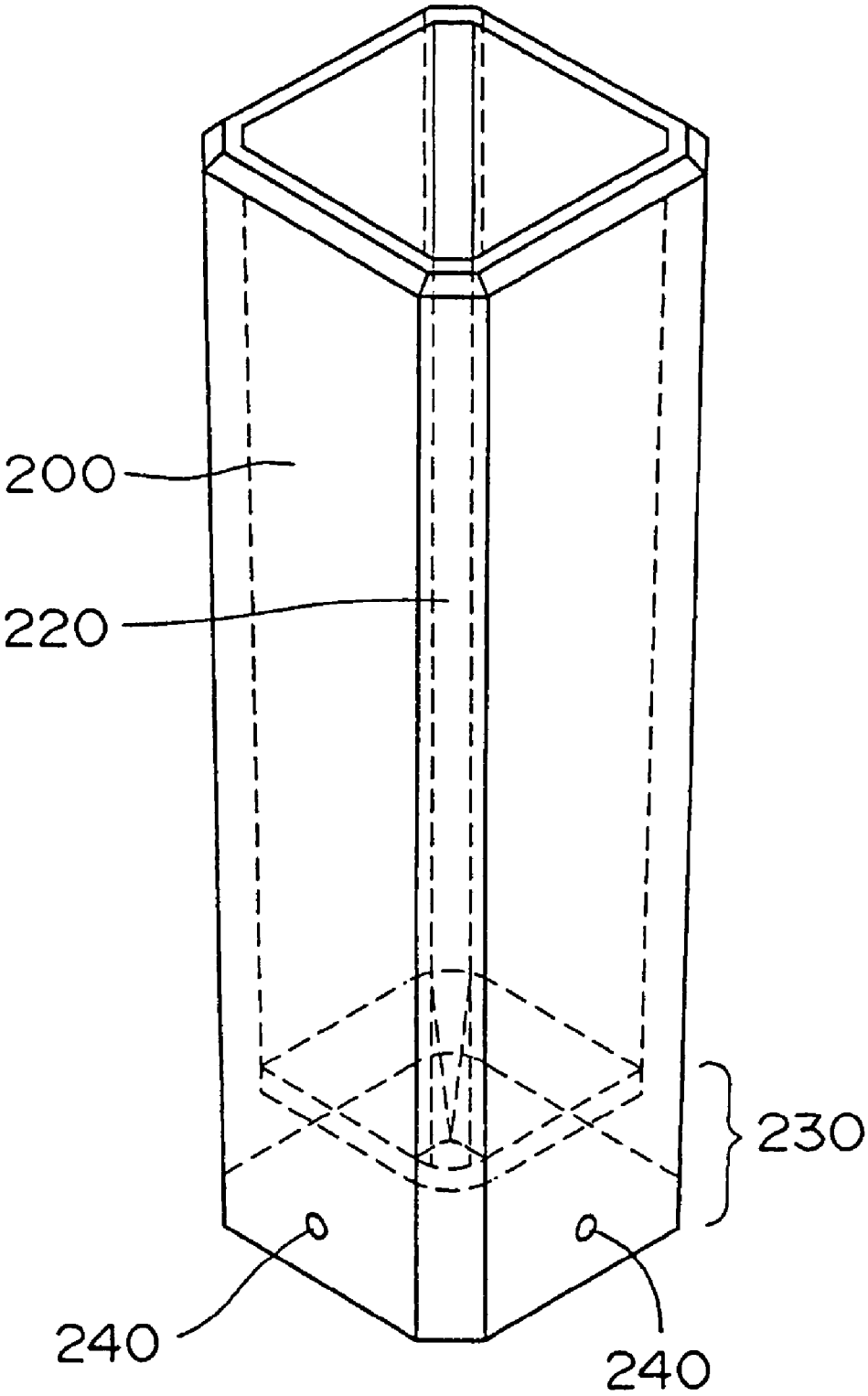
FIGS. 4(*a*) and 4(*b*) are perspective views of a case having a locking circular recess used in the present invention.
Figure 4:
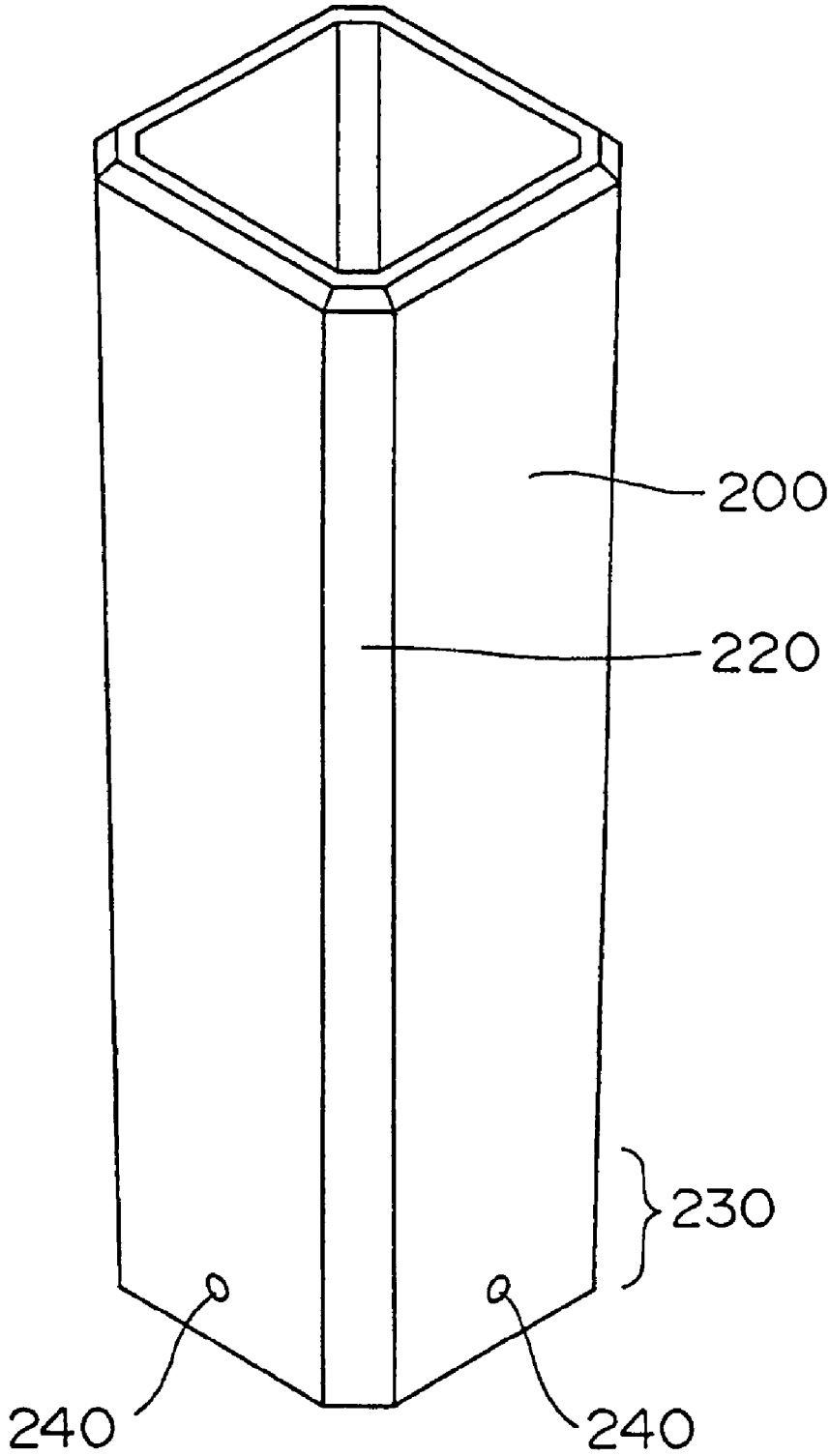

It is noted that in FIGS. 4(*a*) and 5(*a*) broken lines illustrate the interior of the cases in perspective views. FIGS. 4(*b*) and 5(*b*) illustrate the cases in perspective views. Case supporting pins 130 are shown in FIGS. 6(*a*) and 6(*b*). Case supporting pins are circular in cross-section and are tapered thinner as they extend upwardly as viewed in FIGS. 6(*a*) and 6(*b*). Case supporting pins 140 shown in FIGS. 7(*a*) and 7(*b*) are square in cross-section and are tapered thinner as they extend upwardly. Cross-sectional views taken along the lines b-b of FIGS. 6(*a*) and 7(*a*) are shown in FIGS. 6(*b*) and 7(*b*) respectively.

It is noted that when the grate position (i.e., partition) numbers are provided on the top surfaces of case supporting pins 130, 140 and/or near the respective grate intersections of the grate-shaped bottom portions 120, an operator can easily identify the positions (i.e., partition) for inserting or removing a case from the position (partition) of interest. Further, other cross-sectional shapes of the case supporting pins may be used and may constitute any polygonal cross-sectional shape including, for example, a star shape, a circular shape and a square shape.

Cases 200, 300 in the present invention have rectangular cross-sectional shapes and are hollow as shown in FIGS. 4(*a*), 4(*b*) and 5(*a*), 5(*b*). The cases are tapered toward the bottom portions thereof. Additionally the corner portions of the outer surfaces of cases 200, 300 are chamfered at an angle of 45", that is, they are subjected to so-called C chamfering. When a square in cross-section shaped case is used in conjunction with supporting pin 140, each case supporting pin 140 is vertically provided so that a side surface of the case supporting pin 140 abuts or is in proximity to a chamfered surface of the case 200 (300) as shown in FIG. 7(*a*) The chamfered surfaces are denoted by reference numerals 220, 320 in FIGS. 4(*a*), 4(*b*) and 5(*a*), 5(*b*).

Figure 5:
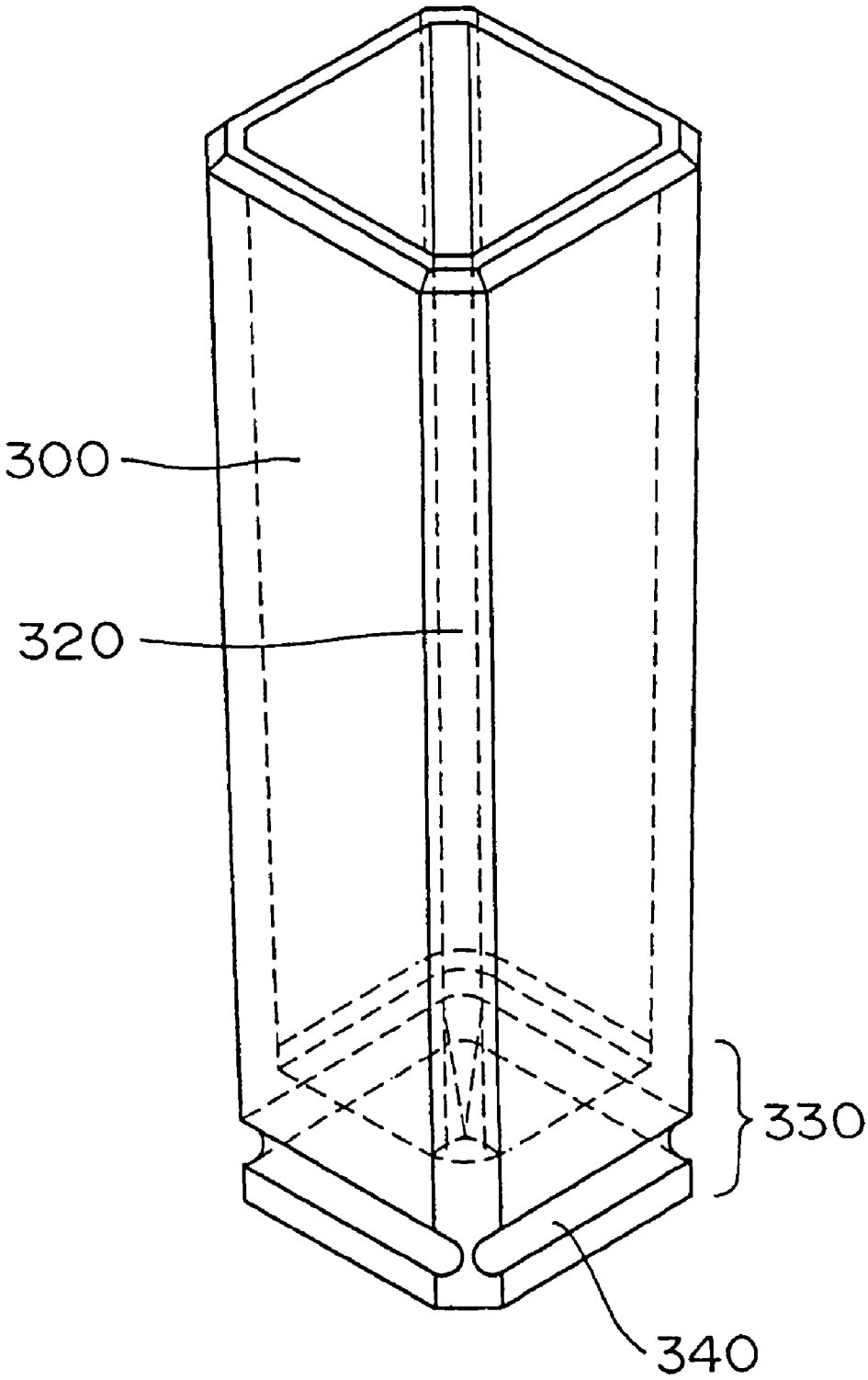
FIGS. 5(*a*) and 5(*b*) are perspective views of a case having a locking horizontal groove portion used in the present invention.
Figure 5:
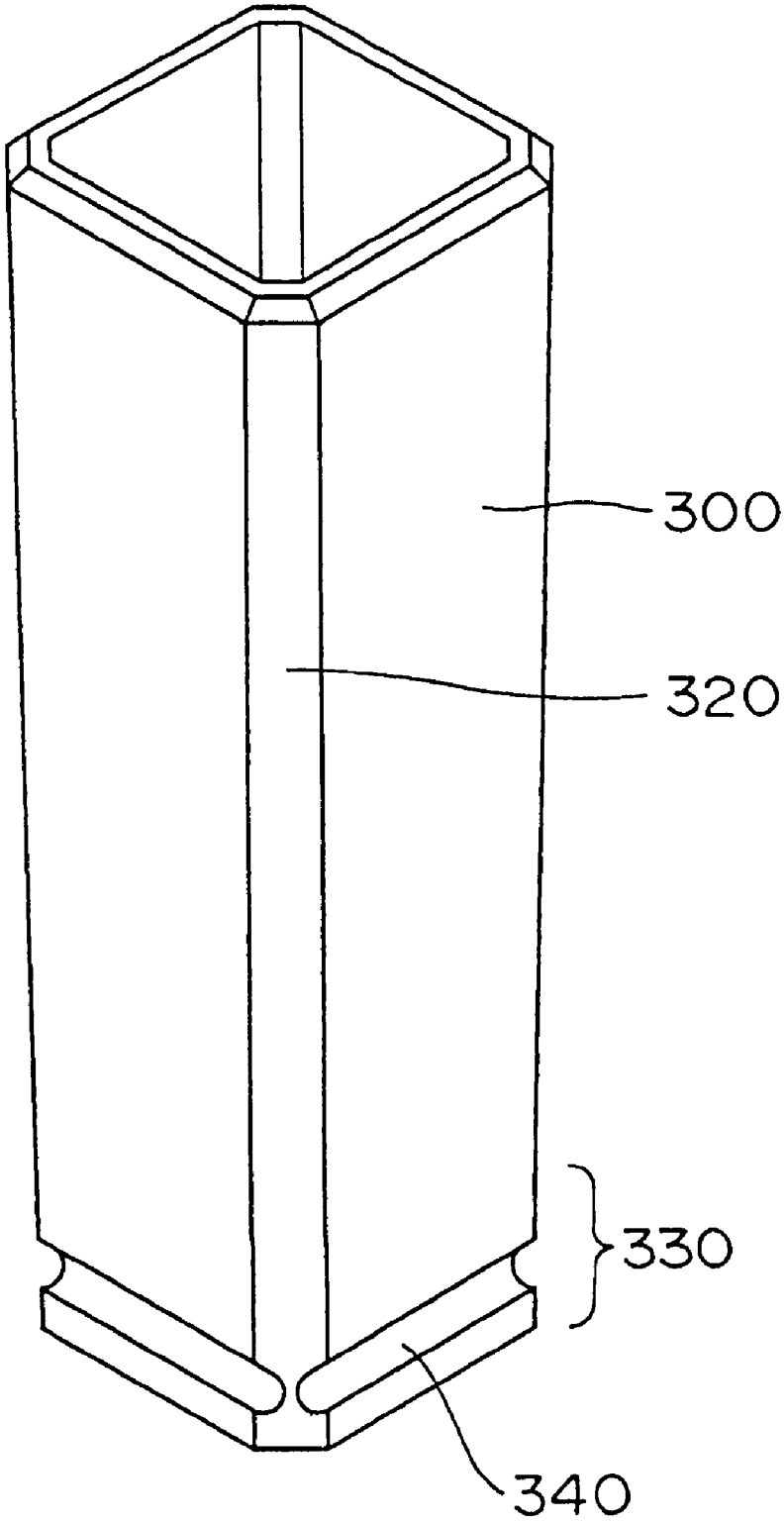

The inner side surfaces of cross members (gratings) forming the grate-shaped bottom portion 120 are provided with case locking protrusions 126 as shown in FIGS. 6(*a*), 6(*b*), 7(*a*) and 7(*b*). Side wall bottom portions 230, 330 of cases 200, 300 are respectively provided with case locking concave portions as shown in FIGS. 4(*a*), 4(*b*), 5(*a*) and 5(*b*). Case 200 in FIGS. 4(*a*) and 4(*b*) include circular recesses 240 as the case locking concave portions. The circular recesses are provided at an intermediate location which can be generally described as the center of each surface of the bottom portion side wall 230. Case 300 in FIGS. 5(*a*) and 5(*b*) illustrate a horizontal extending groove portion 340 as the case locking concave portion. The horizontally extending groove portion is provided at an intermediate location which can be generally described as the center of each surface of the bottom portion side wall 330. And as shown in FIGS. 6(*a*), 6(*b*), 7(*a*) and 7(*b*) when cases 200, 300 are accommodated (placed) into the storage racks 100, the case locking protrusion portions 126 provided on the inner side surfaces of each side of the cross members of the grate-shaped bottom portions 120 are fitted into the circular recesses 240 of the case 200 or the horizontal groove portions 340 of the case 300, so that the case 200, 300 is prevented from falling out of the rack.

It is noted that structure for preventing a case or cases from falling out of a storage rack includes case locking concave portions provided on the cases themselves. The case locking concave portion coacts with protrusions on cross members of grate-shaped bottom portions of the storage rack. Case locking protrusions are provided on the inner side wall of cross members (gratings) of the case.

Also, case locking concave portions may be provided on upper portions of the case and the corresponding case locking protruded portions are provided on side surfaces of the case supporting pins, and the like may be considered.

Next, a storage rack positioning method in a pharmaceutical sample storage system according to the present invention will be described. A storage rack is generally manufactured by resin molding and the outermost surface of the storage rack, that is a rack frame 110 in the present invention, has poor dimensional accuracy. The grate-shaped bottom portion 120 and the case supporting pins 130, 140 extending therefrom are important and are accurately molded by using another more accurate mold. Therefore, it is necessary to position the storage rack based on the grate-shaped bottom portions.

Figure 8:
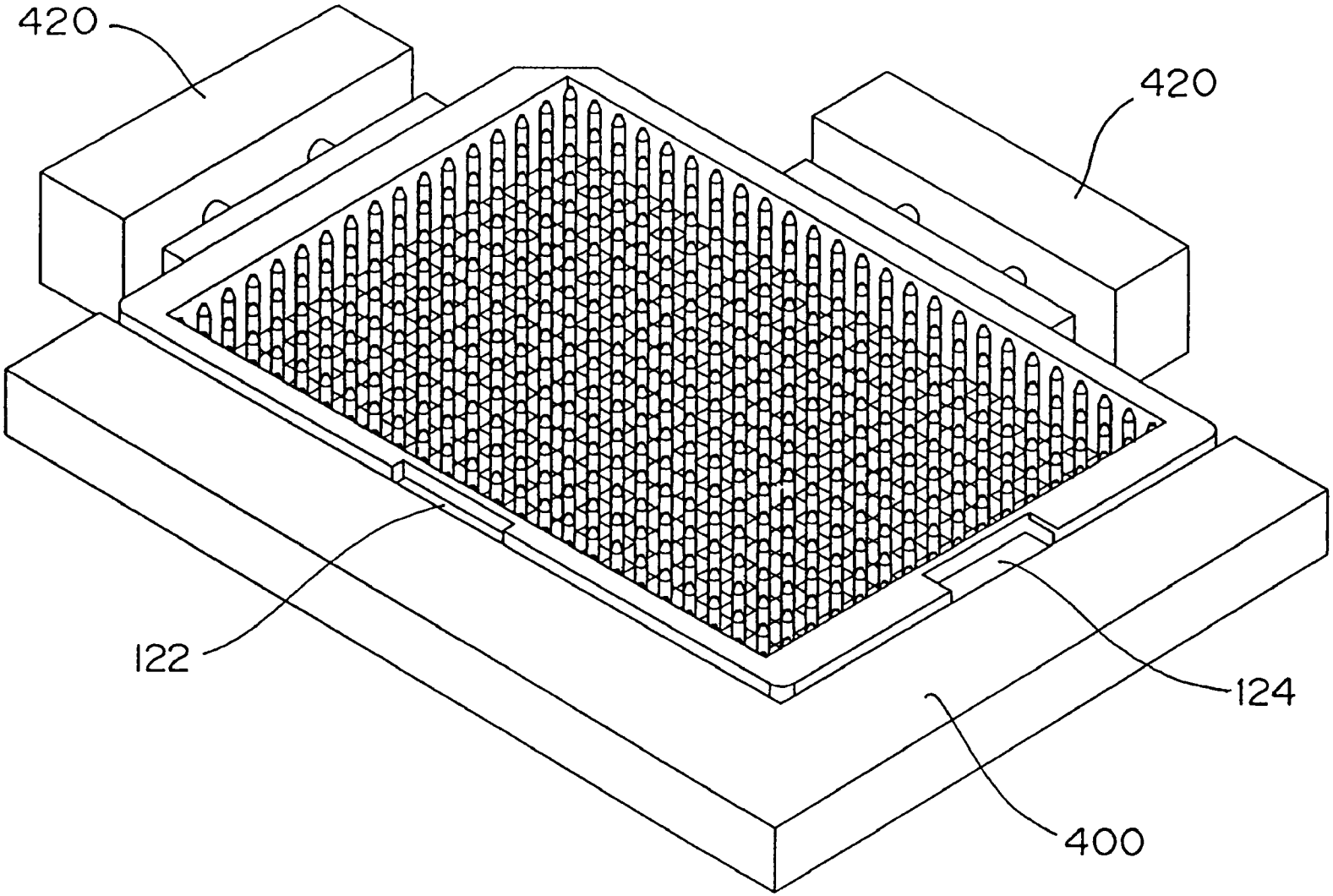
FIG. 8 is a perspective view showing a storage rack positioning structure according to the present invention.
Figure 9:
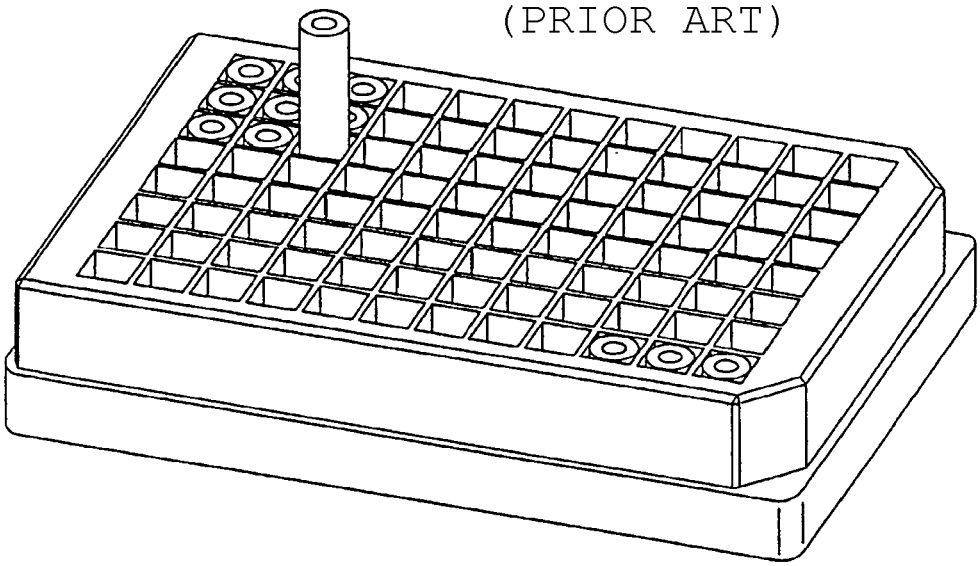
Fig. 9 (a) (PRIOR ART)
FIGS. 9(*a*) and 9(*b*) are perspective views showing a conventional microtube and a storage rack.
Figure 9:
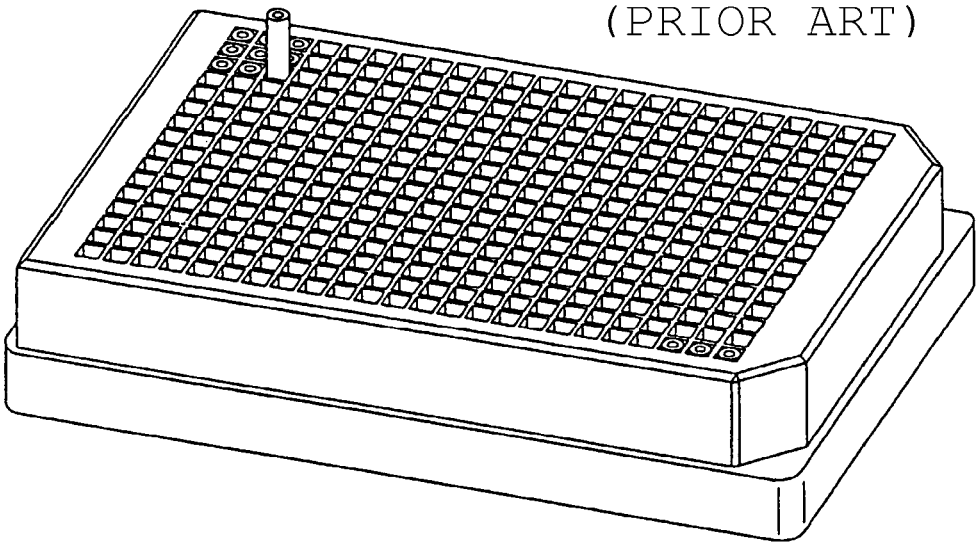
Fig. 9 (b) (PRIOR ART)

Thus as shown in FIGS. 1(*a*), 1(*b*) and 3 the present invention has a structure that positions protruded portions 122, 124 extending from the grate-shaped bottom portion 120 on two surfaces of the grate-shaped bottom portion 120 perpendicular to each other in such a manner that the positioning protruded portions 122, 124 extend from the rack frame 110. See, FIG. 3 wherein protrusion 124 is illustrated as being formed with and molded with grate shaped bottom portion 120. As shown in FIG. 8 a fixing jig 400 abuts the exposed positioning (orienting) protruded portions 122, 124 (positioning or orienting protrusions) and the remaining two surfaces of the grate-shaped bottom portion 120 are held by actuators 420 so that the positioning of the storage rack can be attained based on the accurate dimensions of the grate-shaped bottom portion of the storage rack. The protrusions 122, 124 provide orthogonal reference surfaces to position the grate-shaped bottom portion 120 against fixing jig 400 illustrated in FIG. 8. thus locating all of the highly accurate partitions in a highly accurate manner.

It is noted that in the present invention positioning protruded portions 122, 124 have good dimensional accuracy enabling accurate positioning of the grate-shaped portions 120 as described and shown in FIGS. 1-3.

Figure 10:
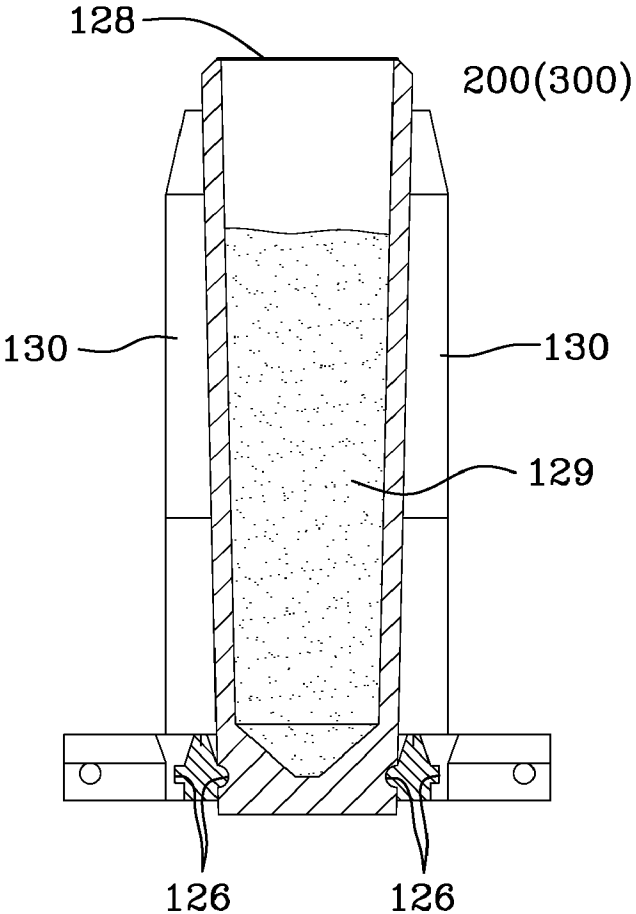
FIGS. 10(*a*) and 10(*b*) are perspective views showing a case having a seal and a sample.
Figure 10:
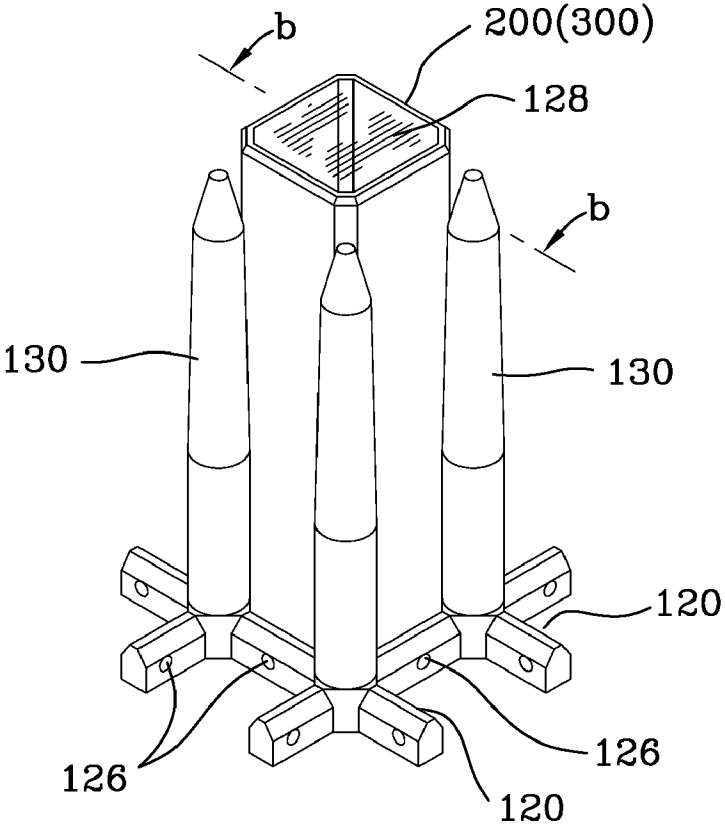

Thus as shown in FIGS. 10(*a*) and 10(*b*), the present invention includes a case 200 (300) with a seal (128) and a sample (129).

Alternatively in an embodiment not shown in the drawings, insertion holes (openings) may be provided on two side surfaces of the rack frame which are perpendicular and which are not dimensionally accurate. Orienting and protruding portions of fixing jigs are inserted into the insertion holes (openings) and the orienting protrusions are urged into engagement with a fixing jig positioning the grate-shaped bottom of the storage rack. Essentially, in this embodiment the fixing jig includes protrusions which engage the dimensionally accurate grate shaped bottom portion.

In the present invention the head portions of the cases are open and these cases are accommodated into a storage rack. Then when the cases are stored and transported an aluminum thin film sheet is adhered to an opening portion of each case by heating deposition. The thin aluminum film sheet is then cut to seal the case.

The present invention accommodates 384 ultramicrotubes while using the same size storage rack which usually accommodates 96 conventional microtubes. Additionally, dead space occupied by partition walls is minimized or eliminated and the capacity of the tube case is increased. Thus, the present invention has significantly high industrial applicability in fields other than the field of pharmaceutical development.

DESCRIPTION OF REFERENCE NUMERALS

100 . . . Storage rack
110 . . . Rack frame
120 . . . Grating-shaped bottom portion
122, 124 . . . Positioning protruded portion
126 . . . Case locking protruded portion
128 . . . Seal
129 . . . Sample
130, 140 . . . Case supporting pin
200, 300 . . . Case
220, 320 . . . Chamfered surface
230, 330 . . . Bottom portion side wall
240 . . . Case locking concave portion (circular recess)
340 . . . Case locking concave portion (horizontal groove portion)
400 . . . Fixing jig
420 . . . Actuator Those skilled in the art will readily recognize that the invention has been set forth by way of example only and that changes and modifications may be made to the invention without departing from the spirit and scope of the invention as set forth below in the appended claims.

The invention claimed is:

1. A pharmaceutical sample storage system, comprising:
cases, said cases include samples, said cases are sealed to prevent the escape of said samples from said cases;
a storage rack frame;
each of said cases is hollow, includes four walls and is rectangularly-shaped in cross-section, each of said cases includes a top portion and a bottom portion, each of said cases is tapered from said top portion of said case toward said bottom portion of said case, each of said cases includes chamfered outer corner portions;

said storage rack frame includes a lower grate-shaped bottom portion, said grate-shaped bottom portion includes cross members, said cross members are arranged in a matrix forming partitions; said cross members forming said partitions include through openings therebetween, said grate-shaped bottom portion includes supporting pins extending upwardly therefrom, said cases are removably stored between said cross members forming said partitions of said lower grate-shaped bottom portion, said supporting pins engaging said chamfered outer corner portions of each of said cases, said bottom portions of each of said cases residing between respective cross members forming said partitions of said grate-shaped bottom portion and between said upwardly extending supporting pins;

each of said cross members forming said partitions of said grate-shaped bottom portion includes inner side surfaces; each of said inner side surfaces includes protrusions, each of said four walls of said cases includes a corresponding locking concave portion, and, said protrusions of each inner side surface of each of said cross members forming said partitions releasably interengage said corresponding locking concave portions of each of said four walls of said cases thereby securing said cases;

said bottom portion of each of said cases extending through a respective through opening between said cross members forming a respective partition in said grate-shaped bottom portion; each of said cases disengageable from said respective through opening between said cross members of said partitions in said grate-shaped bottom portion by application of an upward force on said bottom portion of each said case extending through said respective through opening between said cross members forming said partitions enabling extraction of each said case upwardly by dislodging said protrusions of said inner side surfaces of said cross members forming said partitions of said grate-shaped bottom portions from said corresponding locking concave portions of each said case.

2. A pharmaceutical sample storage system according to claim 1, wherein said supporting pins are circular in cross-section.

3. A pharmaceutical sample storage system according to claim 1, wherein said supporting pins are square in cross-section.

4. A pharmaceutical sample storage system according to claim 1, wherein said supporting pins include a tip portion and said supporting pins are tapered thinner from said grate-shaped bottom portion toward said tip portion.

5. A pharmaceutical sample storage system according to claim 2, wherein said supporting pins include a tip portion and said supporting pins are tapered thinner from said grate-shaped bottom portion toward said tip portion.

6. A pharmaceutical sample storage system according to claim 3, wherein said supporting pins include a tip portion and said supporting pins are tapered thinner from said grate-shaped bottom portion toward said tip portion.

7. A pharmaceutical sample storage system according to claim 1, wherein said grate-shaped bottom portion includes first and second perpendicular sides, first and second positioning protrusions extending from said first and second perpendicular sides of said grate-shaped bottom portion, actuators interengaging said storage rack frame, a fixing jig interengaging said first and second positioning protrusions extending from said first and second perpendicular sides of said grate-shaped bottom portion thereby positioning said cases and said grate-shaped bottom portion of said storage rack frame with respect to said fixing jig, and, said cases are positioned such that said cases may be easily removed from and inserted into said grate-shaped bottom portion of said storage rack frame.

8. A pharmaceutical sample storage system according to claim 2, wherein said grate-shaped bottom portion includes first and second perpendicular sides, first and second positioning protrusions extending from said first and second perpendicular sides of said grate-shaped bottom portion, actuators interengaging said storage rack frame, a fixing jig interengaging said first and second positioning protrusions extending from said first and second perpendicular sides of said grate-shaped bottom portion thereby positioning said cases and said grate-shaped bottom portion of said storage rack frame with respect to said fixing jig, said cases are positioned such that said cases may be easily removed from and inserted into said grate-shaped bottom portion of said storage rack frame.

9. A pharmaceutical sample storage system according to claim 3, wherein said grate-shaped bottom portion includes first and second perpendicular sides, first and second positioning protrusions extending from said first and second perpendicular sides of said grate-shaped bottom portion, actuators interengaging said storage rack frame, a fixing jig interengaging said first and second positioning protrusions extending from said first and second perpendicular sides of said grate-shaped bottom portion thereby positioning said cases and said grate-shaped bottom portion of said storage rack frame with respect to said fixing jig, said cases are positioned such that said cases may be easily removed from and inserted into said grate-shaped bottom portion of said storage rack frame.

10. A pharmaceutical sample storage system according to claim 4, wherein said grate-shaped bottom portion includes first and second perpendicular sides, first and second positioning protrusions extending from said first and second perpendicular sides of said grate-shaped bottom portion, actuators interengaging said storage rack frame, a fixing jig interengaging said first and second positioning protrusions extending from said first and second perpendicular sides of said grate-shaped bottom portion thereby positioning said cases and said grate-shaped bottom portion of said storage rack frame with respect to said fixing jig, said cases are positioned such that said cases may be easily removed from and inserted into said grate-shaped bottom portion of said storage rack frame.

11. A pharmaceutical sample storage system, comprising:

cases, said cases include samples, said cases are sealed to prevent the escape of said samples from said cases;

a storage rack frame;

each of said cases is hollow and rectangularly-shaped in cross-section, each of said cases includes a bottom portion and a top portion, each of said cases is tapered from said top portion of said case toward said bottom portion of said case, each of said cases includes chamfered outer corner portions;

said storage rack frame includes a lower grate-shaped bottom portion, said grate-shaped bottom portion includes cross members, said cross members arranged in a matrix forming partitions;

said cross members forming said partitions include through openings therebetween, said grate-shaped bottom portion includes supporting pins extending upwardly therefrom, said supporting pins include a bottom portion and a top portion, said supporting pins are tapered from said bottom portion toward said top portion, said cases are removably stored between said cross members forming said partitions of said lower grate-shaped bottom portion, said supporting pins engaging said chamfered outer corner portions of each of said cases, said bottom portions of each of said cases residing between respective cross members forming said partitions of said grate-shaped bottom portion and between said upwardly extending tapered supporting pins; and, each of said cross members of said partitions of said grate-shaped bottom portion includes inner side surfaces; each of said inner side surfaces includes protrusions, each of said cases includes corresponding locking concave portions, and, said protrusions of each inner side surface of each of said cross members forming said partitions releasably interengage said corresponding locking concave portions of each of said cases thereby securing said cases.

* * * * *

UNITED STATES PATENT AND TRADEMARK OFFICE

CERTIFICATE OF CORRECTION

PATENT NO. : 7,892,504 B2
APPLICATION NO. : 11/473294
DATED : February 22, 2011
INVENTOR(S) : Taike et al.

It is certified that error appears in the above-identified patent and that said Letters Patent is hereby corrected as shown below:

On the face page of the patent, after "(73) Assignee: Tsubakimoto Chain Co., Osaka (JP)" insert --Kobe Bio Robotix Co., Ltd., Hyogo (JP)--

Signed and Sealed this
Fourteenth Day of June, 2011

David J. Kappos

David J. Kappos
*Director of the United States Patent and Trademark Office*